US009097433B2

(12) United States Patent
Kaneko et al.

(10) Patent No.: US 9,097,433 B2
(45) Date of Patent: Aug. 4, 2015

(54) APPARATUS AND A METHOD FOR CONTROLLING FACILITY DEVICES, AND A NON-TRANSITORY COMPUTER READABLE MEDIUM THEREOF

(75) Inventors: Yu Kaneko, Kanagawa-ken (JP); Shigeo Matsuzawa, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 399 days.

(21) Appl. No.: 13/554,085

(22) Filed: Jul. 20, 2012

(65) Prior Publication Data

US 2013/0085582 A1 Apr. 4, 2013

(30) Foreign Application Priority Data

Sep. 30, 2011 (JP) ..... P2011-218677

(51) Int. Cl.
*G06F 19/00* (2011.01)
*F24F 11/00* (2006.01)

(52) U.S. Cl.
CPC ..... *F24F 11/001* (2013.01); *F24F 2011/0058* (2013.01)

(58) Field of Classification Search
CPC ..... F02F 11/001; F02F 2011/0058
USPC ..... 700/2
See application file for complete search history.

(56) References Cited

U.S. PATENT DOCUMENTS 7,222,800 B2 * 5/2007 Wruck ..... 236/51
7,904,186 B2 * 3/2011 Mairs et al. ..... 700/83
2005/0114382 A1 * 5/2005 Lakshminarayan et al. .. 707/102
2007/0061046 A1 * 3/2007 Mairs et al. ..... 700/275
2007/0067062 A1 * 3/2007 Mairs et al. ..... 700/275
2007/0112755 A1 * 5/2007 Thompson et al. ..... 707/5
2007/0255461 A1 * 11/2007 Brickfield et al. ..... 700/295
2008/0177423 A1 * 7/2008 Brickfield et al. ..... 700/291
2010/0011020 A1 * 1/2010 Bouzid et al. ..... 707/103 R
2010/0106674 A1 * 4/2010 McLean et al. ..... 706/52
2011/0093126 A1 4/2011 Toba et al.
2013/0085582 A1 * 4/2013 Kaneko et al. ..... 700/2

FOREIGN PATENT DOCUMENTS

JP H11-132539 5/1999
JP 2004-023363 1/2004

(Continued)

OTHER PUBLICATIONS

Hanada et al., "NeuroPMV control", Air-Conditioning Control System Prioritizing Comfort, *Special Reports*, vol. 62, No. 6, pp. 24-27.

(Continued)

*Primary Examiner* — Michael D Masinick
(74) *Attorney, Agent, or Firm* — Nixon & Vanderhye, P.C.

(57) ABSTRACT

According to one embodiment, a service execution apparatus controls facility devices in a group. The group includes a plurality of calculation areas. At least one facility device is installed in each calculation area. The service execution apparatus includes a calculation unit and a control unit. The calculation unit is configured to calculate a control value to control a selected facility device installed in one of calculation areas in the group, using weather information relating to the one of calculation areas. The control unit is configured to control other facility devices installed in the calculation areas of the group, based on the control value for the selected facility device.

12 Claims, 18 Drawing Sheets

(56) References Cited

FOREIGN PATENT DOCUMENTS

| | | |
|---|---|---|
| JP | 2006-220345 | 8/2006 |
| JP | 2006-331372 | 12/2006 |
| JP | 2011-80758 | 4/2011 |
| JP | 2011-89682 | 5/2011 |
| JP | 2011-163710 | 8/2011 |

OTHER PUBLICATIONS

Office Action mailed Jun. 20, 2014 in counterpart Japanese Application No. 2011-218677 and English translation thereof.

* cited by examiner

| CALCULATION AREA ID | SERVICE NAME | FACILITY ID | PHYSICAL COORDINATE | PLACE | WEATHER INFORMATION ID |
|---|---|---|---|---|---|
| 1 | COMFORT AIR CONDITIONING | /BUILDING A/ AIR CONDITIONING 1 | 138.12, 34.63 | x PREFECTURE, y CITY, BUILDING A,1F | /weather/jp/138.12-34.63/temp, /weather/jp/138.12-34.63/humidity |
| 2 | COMFORT AIR CONDITIONING | /BUILDING A/ AIR CONDITIONING 2 | 138.08, 35.05 | x PREFECTURE, y CITY, BUILDING A,2F | /weather/jp/138.08-35.05/temp, /weather/jp/138.08-35.05/humidity |
| 3 | COMFORT AIR CONDITIONING | /BUILDING B/ AIR CONDITIONING 1 | 138.49, 35.02 | x PREFECTURE, y CITY, BUILDING B,1F | /weather/jp/138.49-35.02/temp, /weather/jp/138.49-35.02/humidity |

FIG. 3

| GROUP ID | HEAD CALCULATION AREA ID | CALCULATION AREAS ID |
|---|---|---|
| 1 | 1 | 1, 2, 3 |

FIG. 4

| WEATHER INFORMATION ID | TYPE | TIME | VALUE |
|---|---|---|---|
| /weather/jp/138.12-34.63/temp | TEMPERA-TURE | 2011-06-20T12:00:00 | 25.2 |
| /weather/jp/138.12-34.63/humidity | HUMIDITY | 2011-06-20T12:00:00 | 34.0 |
| /weather/jp/138.08-35.05/temp | TEMPERA-TURE | 2011-06-20T12:00:00 | 28.8 |
| /weather/jp/138.08-35.05/humidity | HUMIDITY | 2011-06-20T12:00:00 | 33.9 |
| /weather/jp/138.49-35.02/temp | TEMPERA-TURE | 2011-06-20T12:00:00 | 29.1 |
| /weather/jp/138.49-35.02/humidity | HUMIDITY | 2011-06-20T12:00:00 | 41.5 |
| /weather/jp/138.12-34.63/temp | TEMPERA-TURE | 2011-06-20T12:10:00 | 25.2 |
| /weather/jp/138.12-34.63/humidity | HUMIDITY | 2011-06-20T12:10:00 | 34.0 |
| /weather/jp/138.08-35.05/temp | TEMPERA-TURE | 2011-06-20T12:10:00 | 28.4 |
| /weather/jp/138.08-35.05/humidity | HUMIDITY | 2011-06-20T12:10:00 | 35.0 |
| /weather/jp/138.49-35.02/temp | TEMPERA-TURE | 2011-06-20T12:10:00 | 29.0 |
| /weather/jp/138.49-35.02/humidity | HUMIDITY | 2011-06-20T12:10:00 | 30.7 |

FIG. 5

| FACILITY ID | IP ADDRESS | PROTOCOL | NOTE |
|---|---|---|---|
| /BUILDING 60A/ AIR CONDITIONING 1 | 192.168.1.100 | BACnet/IP | objectID=AnalogOutput1 |
| /BUILDING 60A/ AIR CONDITIONING 2 | 192.168.1.100 | BACnet/IP | objectID=AnalogOutput2 |
| /BUILDING 60B/ AIR CONDITIONING 1 | 192.168.1.200 | BACnet/WS | EPR=http://192.168.1.200/BACnetWS |

FIG. 6

| HEAD CALCULATION AREA ID | VARIATION OF TEMPERATURE | VARIATION OF HUMIDITY |
|---|---|---|
| 1 | +0.2 | +2.4 |
| 2 | 0.0 | +3.7 |
| 3 | -0.3 | -5.4 |

FIG. 9

| SERVICE NAME | DECISION EQUATION OF WEATHER CHANGE |
| --- | --- |
| COMFORT AIR CONDITIONING | (ABSOLUTE VALUE OF VARIATION OF TEMPERATURE>0.5) AND (ABSOLUTE VALUE OF VARIATION OF HUMIDITY>5.0) |

FIG. 10

| CALCULATION AREA ID | THE NUMBER OF SYNCHRONIZATION WITH CALCULATION AREA 1 | THE NUMBER OF SYNCHRONIZATION WITH CALCULATION AREA 2 | THE NUMBER OF SYNCHRONIZATION WITH CALCULATION AREA 3 | PROBABILITY TO SYNCHRONIZE WITH CALCULATION AREA 1 | PROBABILITY TO SYNCHRONIZE WITH CALCULATION AREA 2 | PROBABILITY TO SYNCHRONIZE WITH CALCULATION AREA 3 |
|---|---|---|---|---|---|---|
| 1 | | 10 | 20 | | 25% | 50% |
| 2 | | | 30 | | | 75% |
| 3 | | | | | | |

FIG. 14

APPARATUS AND A METHOD FOR CONTROLLING FACILITY DEVICES, AND A NON-TRANSITORY COMPUTER READABLE MEDIUM THEREOF

CROSS-REFERENCE TO RELATED APPLICATION

This application is based upon and claims the benefit of priority from Japanese Patent Application No. 2011-218677, filed on Sep. 30, 2011; the entire contents of which are incorporated herein by reference.

FIELD

Embodiments described herein relate generally to an apparatus and a method for controlling facility devices, and a non-transitory computer readable medium thereof.

BACKGROUND

Recently, a remote energy saving service is mainly executed for medium and minor scaled buildings as a target. The remote energy saving service is a service to provide the medium and minor scaled buildings with an energy saving service via an Internet. In general, the energy saving service is operating on a server (service execution apparatus) of a data center.

Next, conventional technique related to the energy saving service is explained. As a first technique, based on a temperature or humidity, the air taken in a room is controlled. As a second technique, based on a temperature, humidity or $CO_2$ density, air conditioning or lighting is controlled. As a third technique, based on a temperature, humidity or amount of solar radiation, air conditioning is controlled.

Three specific features common to above-mentioned conventional technique are explained. As a first feature, as to each space (calculation area) such as a room (For example, a meeting room, a laboratory) or a passage, calculation to determine a control value for air conditioning or lighting is executed. As a second feature, in order to calculate the control value, weather information (a temperature, humidity, velocity of wind, amount of solar radiation) is used. As a third feature, calculation of the control value is repeated at an interval of several minutes~several ten minutes.

Here, the calculation of the control value is complicated by using an input of the weather information. In the conventional technique, as to each calculation area as a service target, the calculation of the control value is executed at a predetermined interval. Accordingly, one service execution apparatus cannot provide many buildings with the service.

BRIEF DESCRIPTION OF THE DRAWINGS

FIG. 3 is one example of information stored in a calculation area storage unit 104 in the service execution apparatus 100 of FIG. 1.

FIG. 4 is one example of information stored in a group storage unit 105 in the service execution apparatus 100 of FIG. 1.

FIG. 5 is one example of information stored in a weather information storage unit 106 in the service execution apparatus 100 of FIG. 1.

FIG. 6 is one example of information stored in a facility information storage unit 107 in the service execution apparatus 100 of FIG. 1.

FIG. 9 is one example of information stored in a weather variation storage unit 209 in the service execution apparatus 200 of FIG. 8.

FIG. 10 is one example of information stored in a weather change-decision condition storage unit 211 in the service execution apparatus 200 of FIG. 8.

FIG. 14 is one example of information stored in a weather change-synchronization probability storage unit 314 in the service execution apparatus 300 of FIG. 13.

DETAILED DESCRIPTION

According to one embodiment, a service execution apparatus controls facility devices in a group. The group includes a plurality of calculation areas. At least one facility device is installed in each calculation area. The service execution apparatus includes a calculation unit and a control unit. The calculation unit is configured to calculate a control value to control a selected facility device installed in one of calculation areas in the group, using weather information relating to the one of calculation areas. The control unit is configured to control other facility devices installed in the calculation areas of the group, based on the control value for the selected facility device.

Various embodiments will be described hereinafter with reference to the accompanying drawings.

(The First Embodiment)

Figure 1:
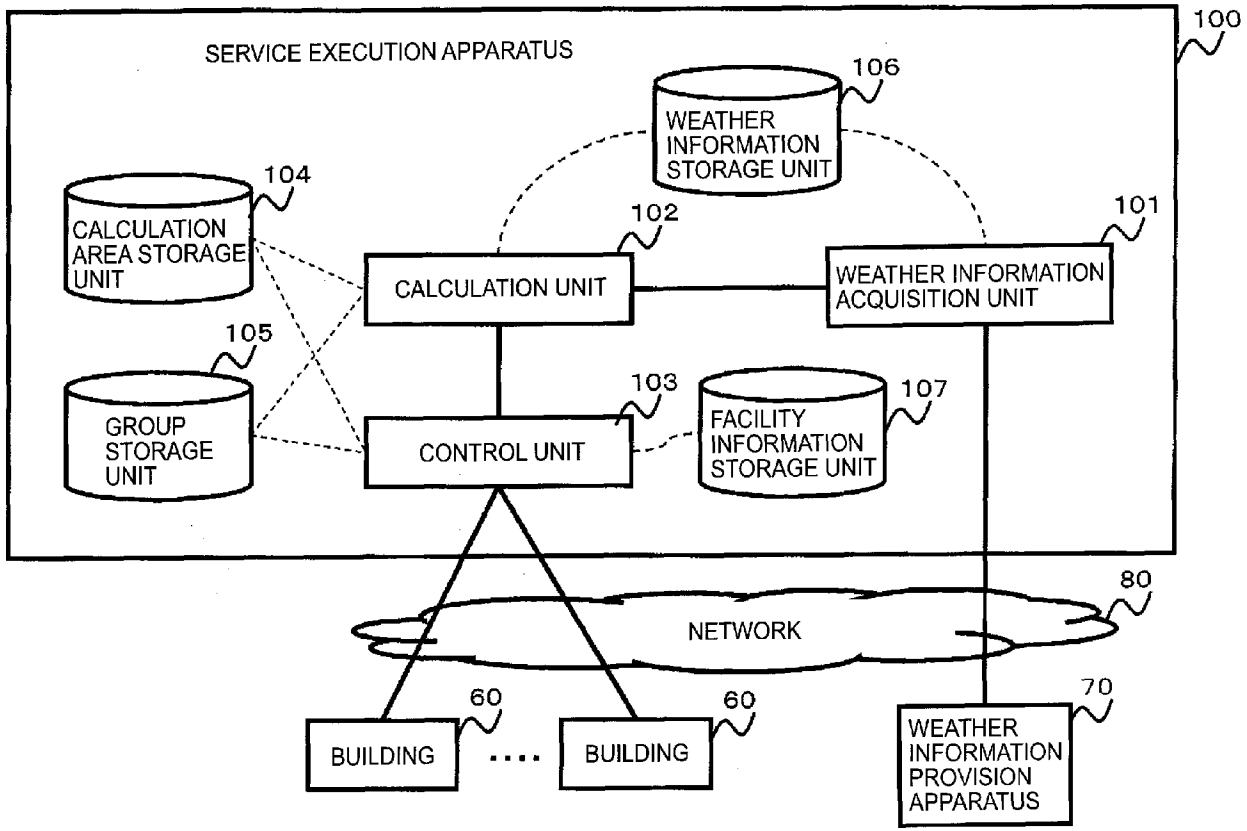
FIG. 1 is a block diagram of a system including a service execution apparatus according to the first embodiment.

FIG. 1 is a block diagram of a system including a service execution apparatus 100 of the first embodiment. As shown in FIG. 1, in the system of the first embodiment, the service execution apparatus 100 and a plurality of buildings 60 are connected via a network 80. Furthermore, a weather information provision apparatus 70 is connected to the service execution apparatus 100 via the network 80.

Figure 2:
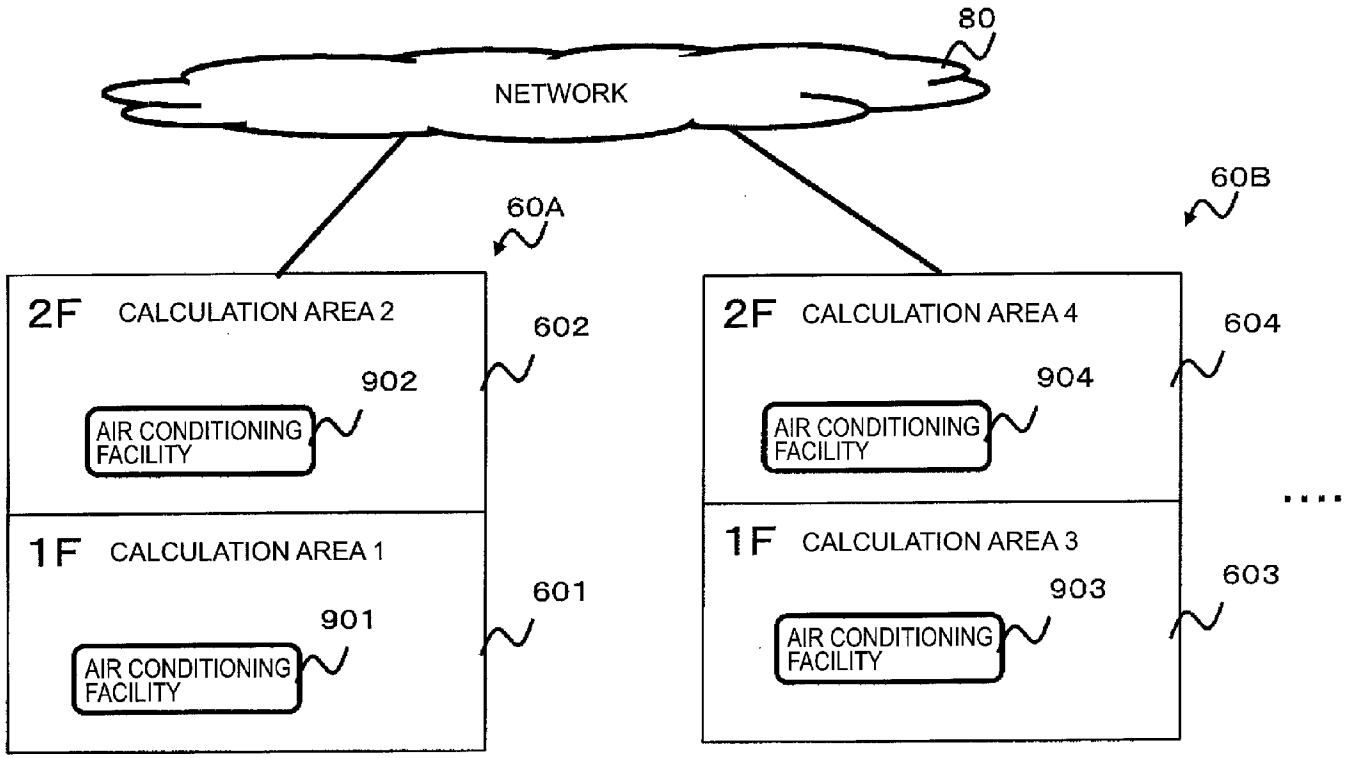
FIG. 2 is a block diagram of detail component of a building 60 in the system of FIG. 1.

FIG. 2 is a block diagram showing detail component of buildings 60A and 60B among the plurality of buildings 60 in FIG. 1. The buildings 60A and 60B respectively include a plurality of calculation areas, and each calculation area includes an air conditioning facility to control air conditioning thereof. In the first embodiment, a calculation area 1 (601 in FIG. 2) is a first floor of the building 60A, a calculation area 2 (602 in FIG. 2) is a second floor of the building 60B, and the calculation area is installed in each floor. Furthermore, a calculation area 3 (603 in FIG. 2) is a first floor of the building 60B, and a calculation area 4 (604 in FIG. 2) is a second floor of the building 60B. Furthermore, one air conditioning facility is installed in each calculation area (In FIG. 2, an air conditioning facility installed in the calculation area 601~604 is respectively the air conditioning facility 901~904.).

Moreover, the calculation area is not always installed in each floor. For example, the calculation area may be installed in each room. Furthermore, the air conditioning facility is not always installed in each calculation area. The air conditioning facility may control the calculation area from outside by installing outside thereof. In the first embodiment, one air conditioning facility is installed in each calculation area. However, a plurality of various facilities may be installed in one calculation area.

Next, by referring to FIG. 1, the service execution apparatus 100 is explained. The service execution apparatus 100 includes a weather information acquisition unit 101, a calculation unit 102, a control unit 103, a calculation area storage unit 104, a group storage unit 105, a weather information storage unit 106, and a facility information storage unit 107. Hereinafter, each unit of the service execution apparatus 100 is explained.

The weather information acquisition unit 101 acquires weather information around the calculation area from the weather information provision apparatus 70, and stores it into the weather information storage unit 106. For example, the weather information provision apparatus 70 is a server of Japan Meteorological Agency or Weather News to provide a Web browser with weather information.

Based on group information stored in the group storage unit 105, the calculation unit calculates a control value. In this case, weather information stored in the weather information storage unit 106 is utilized.

Based on the control value calculated by the calculation unit 102, the control unit 103 controls a facility of the building 60. For example, by using a communication protocol such as BACnet/IP or BACnet/WS, the calculation unit 102 communicates with the facility of the building 60.

The calculation area storage unit 104 stores information of all calculation areas as a service target. The calculation area storage unit 104 stores a calculation area ID, a service name, a facility ID, a physical coordinate, a place, and a weather information ID for each calculation area. The calculation area ID is an ID to uniquely identify the calculation area. The service name is a name of a service provided for the calculation area. The facility ID is an ID of a facility (such as the air conditioning or the lighting) affecting on an environment of the calculation area. The physical coordinate is a coordinate of the calculation area in a physical coordinate axis. The place is a location of the calculation area. The weather information ID is an ID of weather information around the calculation area.

FIG. 3 shows one example of information stored in the calculation area storage unit 104. In FIG. 3, the physical coordinate of the calculation area is represented by the latitude and longitude. By adding a height, the physical coordinate may be three-dimensionally represented. Furthermore, as the weather information related to each calculation area, a temperature and humidity are imaged. By adding an amount of sunshine irradiation or a speed of wind, the weather information may be managed.

The group information stores group information as a grouping result of calculation areas. The group storage unit 105 stores a group ID, a head calculation area ID and calculation areas ID for each group. The group ID is an ID to uniquely identify a group. The head calculation area ID is a calculation area ID of a calculation area as a head of the group. The calculation areas ID is calculation area IDs of calculation areas included in the group.

FIG. 4 shows one example of information stored in the group storage unit 105. In FIG. 4, a group 1 includes calculation areas 1, 2 and 3, and a head calculation area is the calculation area 1. Moreover, in FIG. 4, the group 1 is only shown. However, a plurality of groups may be stored. For example, if a group 2 includes calculation areas 4, 5 and 6 and a group 3 includes calculation areas 7 and 8, the groups 2 and 3 may be stored.

For example, the group is determined based on a physical coordinate of the calculation area. When a distance between physical coordinates of calculation areas is below a threshold L, the calculation areas belong to the same group. For example, the threshold L is determined from a speed of the wind and an interval of an energy saving service's calculation. The speed of the wind affects on a moving of a cloud. Briefly, the speed of the wind affects on a temperature and an amount of sunshine irradiation. If the speed of the wind is 5 m/s and the interval of the energy saving service's calculation is ten minutes, a moving distance of the cloud in ten minutes is approximately 3000 m. Accordingly, the threshold L is set to 3000 m.

The weather information storage unit 106 stores weather information around the calculation area. The weather information is stored as a combination of the weather information ID and a time thereof.

FIG. 5 shows one example of information stored in the weather information storage unit 106. In FIG. 5, a value at "2011-06-20-T12:00:00" and a value at "2011-06-20-T12:10:00" are stored for six weather information.

The facility information storage unit 107 stores information necessary for controlling a facility device. A facility ID, an IP address, a communication protocol and a note, are stored for each facility device. The IP address is an address to be indicated to communicate with a facility device. The communication protocol is information to indicate a protocol to be utilized in case of communicating with the facility device. The note indicates information to grasp in case of communicating by the indicated protocol.

FIG. 6 shows one example of information stored in the facility information storage unit 107. From information of FIG. 6, when a facility "/building 60A/air conditioning 1" is controlled by communication, the destination address is 192.168.1.100, the communication protocol is BACnet/IP, and an ID to identify the facility with a level of BACnet/IP is AnalogOutput1. Furthermore, when the facility "/building 60B/air conditioning 1" is controlled by communication, the destination address is 192.168.1.200, the communication protocol is BACnet/WS, and EPR (End Point Reference) of Web service is "http://192.168.1.200/BACnetWS".

Thus far, each unit of the service execution apparatus 100 is already explained.

Figure 7:
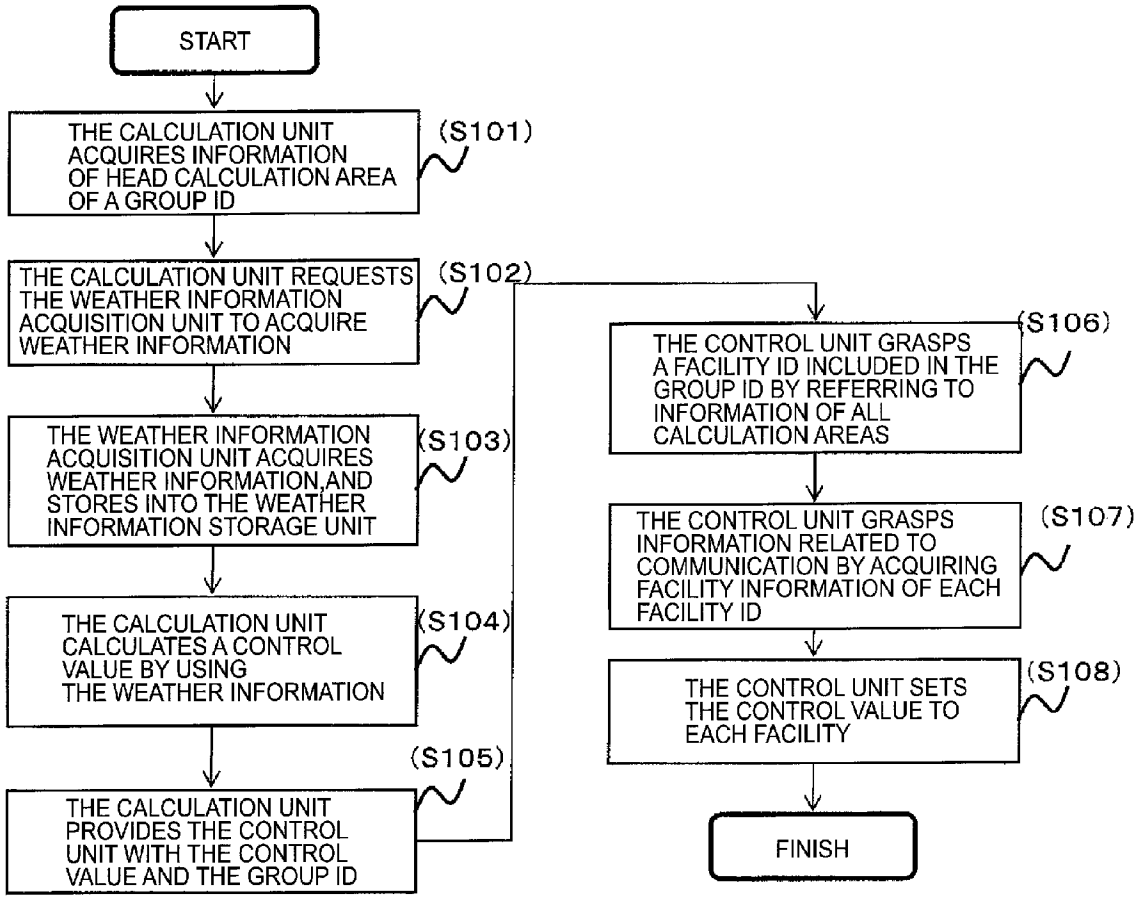
FIG. 7 is a flow chart of processing of the service execution apparatus 100 in FIG. 1.

FIG. 7 is a flow chart of processing of the service execution apparatus 100. By referring to information of all groups stored in the group storage unit 105, the calculation unit 102 executes following processing of each group at a predetermined interval.

First, by referring to a head calculation area ID of the group, the calculation unit 102 acquires calculation area information of the head calculation area ID from the calculation area storage unit 104 (S101) (Refer to FIGS. 3 and 4).

Next, the calculation unit 102 grasps weather information IDs related to the head calculation area, and requests the weather information acquisition unit 101 to acquire weather information (S102).

Next, the weather information acquisition unit 101 acquires weather information based on the weather information IDs, and stores it into the weather information storage unit 106 (Refer to FIG. 5). Furthermore, the weather information acquisition unit 101 notifies the calculation unit 102 of completion of acquisition (S103).

Next, the calculation unit 102 calculates a control value based on the weather information stored in the weather information storage unit 106 (S104).

Next, the calculation unit 102 provides the control unit 103 with a group ID and the control value (S105).

Next, by referring to the group storage unit 105, the control unit 103 grasps IDs of calculation areas included in the group ID. Then, by referring to the calculation area storage unit 104, the control unit 103 grasps a facility ID related to each calculation area (S106) (Refer to FIGS. 3 and 4).

Next, based on the facility ID, the control unit 103 grasps information to execute control from the facility information storage unit 107 (S107) (Refer to FIG. 6).

Next, the control unit 103 communicates with a facility indicated by the facility ID, and sets the control value (provided by the calculation unit 102) to the facility (S108).

Thus far, processing of the energy saving service execution apparatus 100 of the first embodiment is already explained. In conventional technique, calculation processing is executed for each calculation area. However, in the first embodiment, the calculation processing is executed for each group, and a plurality of calculation areas belonging to the group is controlled based on the calculation result. Accordingly, in comparison with the conventional technique, processing load required for execution of the energy saving service can be reduced. As a result, the number of buildings to be provided with the service by one apparatus 100 (to execute energy saving service) can increase.

Moreover, in the first embodiment, in case of determining a group, when a distance between physical coordinates of calculation areas is below a threshold L, the calculation areas is decided to belong to the same group. In case of determining the threshold L, the threshold L is calculated by a speed of the wind and an interval to calculate the energy saving service. However, a method for determining the threshold L is not limited to this method. Ideally, by determining the threshold L so that a weather status of each calculation area belonging to the group is same, grouping of the calculation areas had better performed. More actually, the threshold L had better be determined to create a group so that weather conditions of calculation areas in the group are similar. Furthermore, in order to determine a group of calculation areas, for example, a method for grouping calculation areas included in the same building may be used.

(The Second Embodiment)

In the first embodiment, by grouping a plurality of calculation areas, calculation of energy saving service is executed for each group. In the second embodiment, by deciding weather change, processing load required for execution of the energy saving service can be further reduced. Hereinafter, processing thereof is explained.

As to the energy saving service, basically, weather information is inputted, and a control value is outputted. For example, as to a service to control a comfort air conditioning, a temperature, humidity or an amount of sunshine irradiation is inputted, calculation thereof is executed, and a temperature to set to the air conditioning is outputted. Accordingly, by executing calculation only when weather information changes, the processing load can be reduced. However, in this case, processing to decide change of the weather information is necessary.

Figure 8:
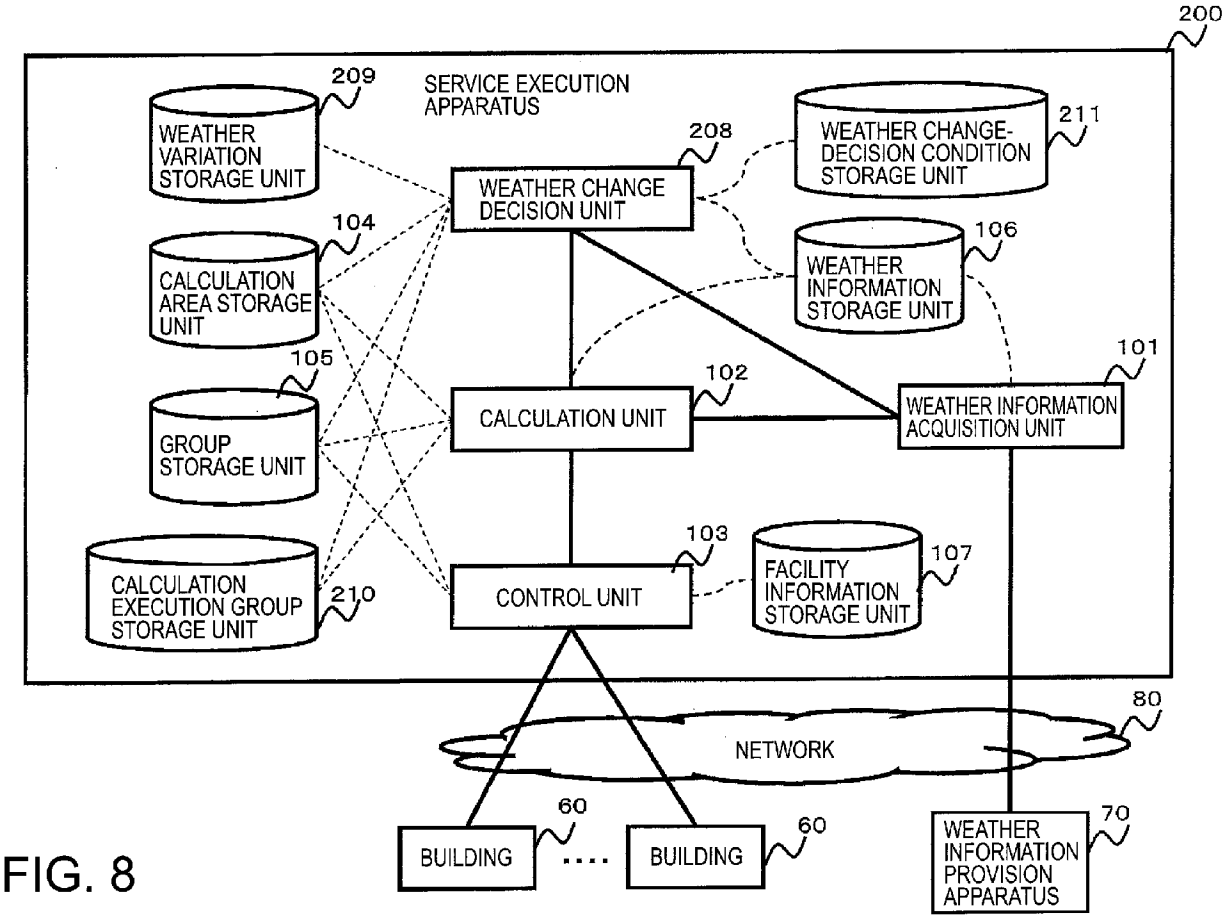
FIG. 8 is a block diagram of a system including a service execution apparatus 200 according to the second embodiment.

FIG. 8 is a block diagram of a system including a service execution apparatus 200 of the second embodiment. In addition to the service execution apparatus 100 of the first embodiment, the service execution apparatus 200 of the second embodiment includes a weather change decision unit 208, a weather variation storage unit 209, a calculation execution group storage unit 210, and a weather change-decision condition storage unit 211.

The weather change decision unit 208 decides weather has changed for a head calculation area of each group. The case that weather (around a group) has changed means that control of energy saving service should be executed for calculation areas of the group.

The weather variation storage unit 209 stores a weather variation of each head calculation area. The weather variation is, by setting a standard value as a weather value at a time when the weather has recently changed, represented as a difference between the standard value and the present value. The weather variation in the past is utilized for deciding weather change. FIG. 9 shows one example of information stored in the weather variation storage unit 209.

In FIG. 9, as to the head calculation area 1, from a time when the weather has previously changed, the temperature rises as 0.2° C., and the humidity increases as 2.4%. Furthermore, as to the head calculation area 3, from a time when the weather has previously changed, the temperature descends as 0.3° C., and the humidity descends as 5.4%. Except for temperature and humidity, variation of amount of sunshine irradiation may be stored.

The calculation execution group storage unit 210 stores only ID of a group to be executed with calculation because of change of weather.

The weather change-decision condition storage unit 211 stores a condition to decide that weather has changed for each energy saving service. The condition is represented by an equation of which variables are the weather variation. FIG. 10 shows one example of information stored in the weather change-decision condition storage unit 211.

In FIG. 10, in case of providing a service of comfort air conditioning, when an absolute value of variation of temperature is above 0.5 and an absolute value of variation of humidity is above 0.5, it is decided that weather has changed.

Figure 11:
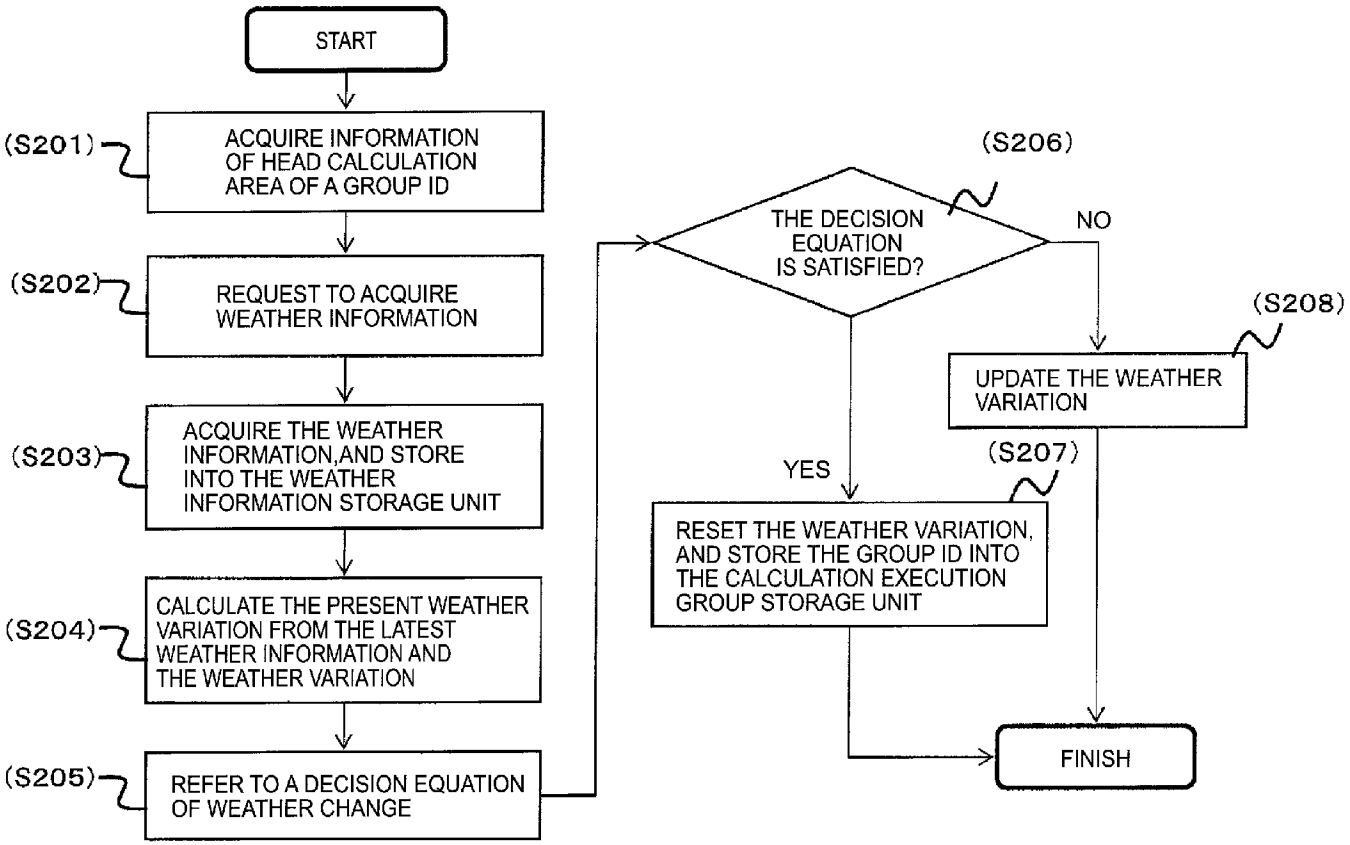
FIG. 11 is a flow chart of processing of a weather change decision unit 208 in the service execution apparatus 200 of FIG. 8.

FIG. 11 is a flow chart of processing of the weather change decision unit 208.

By referring to information of groups stored in the group storage unit 105, the weather change decision unit 208 executes following processing of each group at a predetermined interval.

By referring to a head calculation area ID of a group ID, the weather change decision unit 208 acquires information of the head calculation area from the calculation area storage unit 104 (S201) (Refer to FIGS. 3 and 4).

Next, the weather change decision unit 208 provides the weather information acquisition unit 101 with weather information IDs related to the head calculation area, and requests to acquire weather information (S202).

Next, the weather information acquisition unit 101 acquires weather information based on the weather information IDs, and stores it into the weather information storage unit 102 (S203). Furthermore, the weather information acquisition unit 101 notifies the weather change decision unit 208 of completion of acquisition.

Next, the weather change decision unit 208 refers the latest weather information stored in the weather information storage unit 106 (Refer to FIG. 5). Furthermore, the weather change decision unit 208 calculates the present weather variation by referring to the past weather variation of the head calculation area from the weather variation storage unit 209 (S204) (Refer to FIG. 9).

Next, by referring to the weather change-decision condition storage unit 211, the weather change decision unit 208 grasps a decision equation of weather change (S205) (Refer to FIG. 10).

Next, based on the present weather variation, the weather change decision unit 208 decides whether the decision equation of weather change is satisfied (S206).

When the decision equation is satisfied (Yes at S206), it is decided that the weather has changed. In this case, the calculation should be executed. Accordingly, the calculation execution group storage unit 210 stores the group ID (S207). Furthermore, values stored in the weather variation storage unit 209 are reset by "0".

On the other hand, when the decision equation is not satisfied (No at S206), it is decided that the weather has not changed. In this case, values of the weather variation storage unit 209 are updated by the present weather variation (S208). Moreover, when the decision equation is not satisfied, the calculation execution group storage unit 210 does not store the group ID.

At a time when processing of the weather change decision unit 208 is completed, if the calculation execution group storage unit 210 stores at least one group ID to be executed with calculation, processing is subjected to the calculation unit 102 and the control unit 103.

Figure 12:
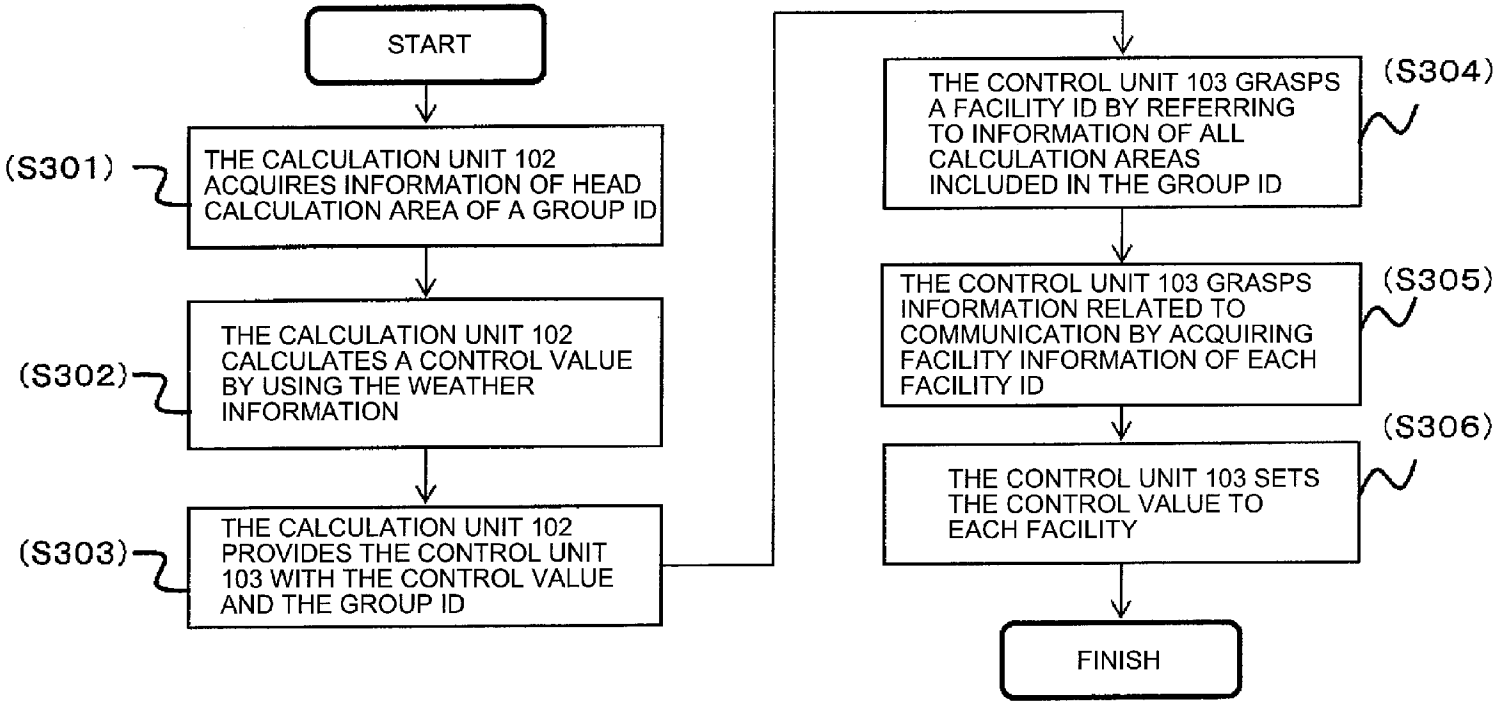
FIG. 12 is a flow chart of processing of a calculation unit 102 and a control unit 103 in the service execution apparatus 200 of FIG. 8.

FIG. 12 is a flow chart of processing of the calculation unit 102 and the control unit 103 in the service execution apparatus 200. By referring to the calculation execution group storage unit 210, the calculation unit 102 and the control unit 103 executes following processing (FIG. 12) for each group ID.

First, the calculation unit 102 grasps a head calculation area from the group ID (S301) (Refer to FIG. 4).

Next, based on weather information stored in the weather information storage unit 106, the calculation unit 102 calculates a control value (S302). In this case, the weather information acquired by the weather change decision unit 208 is utilized again.

Next, the calculation unit 102 provides the control unit 103 with the group ID and the control value (S303).

Next, by referring to the group storage unit 105, the control unit 103 grasps calculation area IDs included in the group ID. Then, by referring to the calculation area storage unit 104, the control unit 103 grasps a facility ID related to each calculation area (S304) (Refer to FIGS. 3 and 4).

Next, based on the facility ID, the control unit 103 grasps information to execute control from the facility information storage unit 107 (S305) (Refer to FIG. 6).

Next, by communicating with a facility indicated by the facility ID, the control unit 103 sets the control value provided by the calculation unit 102 (S306). When calculation and control for all calculation execution groups are completed, information of the calculation execution group storage unit 210 is deleted.

Thus far, operation of the service execution apparatus 200 is already explained. According to the second embodiment, by deciding change of weather information for each group, calculation for a group of which weather information does not change is omitted. Accordingly, in comparison with the first embodiment, processing load required for execution of energy saving service can be more lowered.

(The Third Embodiment)

In the second embodiment, as mentioned-above, by deciding weather change for each group, calculation of a group of which weather does not change is omitted. In this case, as to a head calculation area of each group, weather change is decided. Accordingly, among the head calculation area and other calculation areas belonging to the same group, it is ideal that timings of weather change thereof completely coincide.

However, in the second embodiment, calculation areas are simply grouped by using physical coordinates thereof. Actually, among the head calculation area and other calculation areas belonging to the same group, it sometimes happens that timings of weather change thereof do not coincide. Briefly, even if weather of another calculation area (belonging to the same group as a head calculation area) changed, if weather of the head calculation area does not change, calculation and control are not executed for the another calculation area. This situation badly affects on comfortability and energy saving efficiency of another calculation area.

Figure 13:
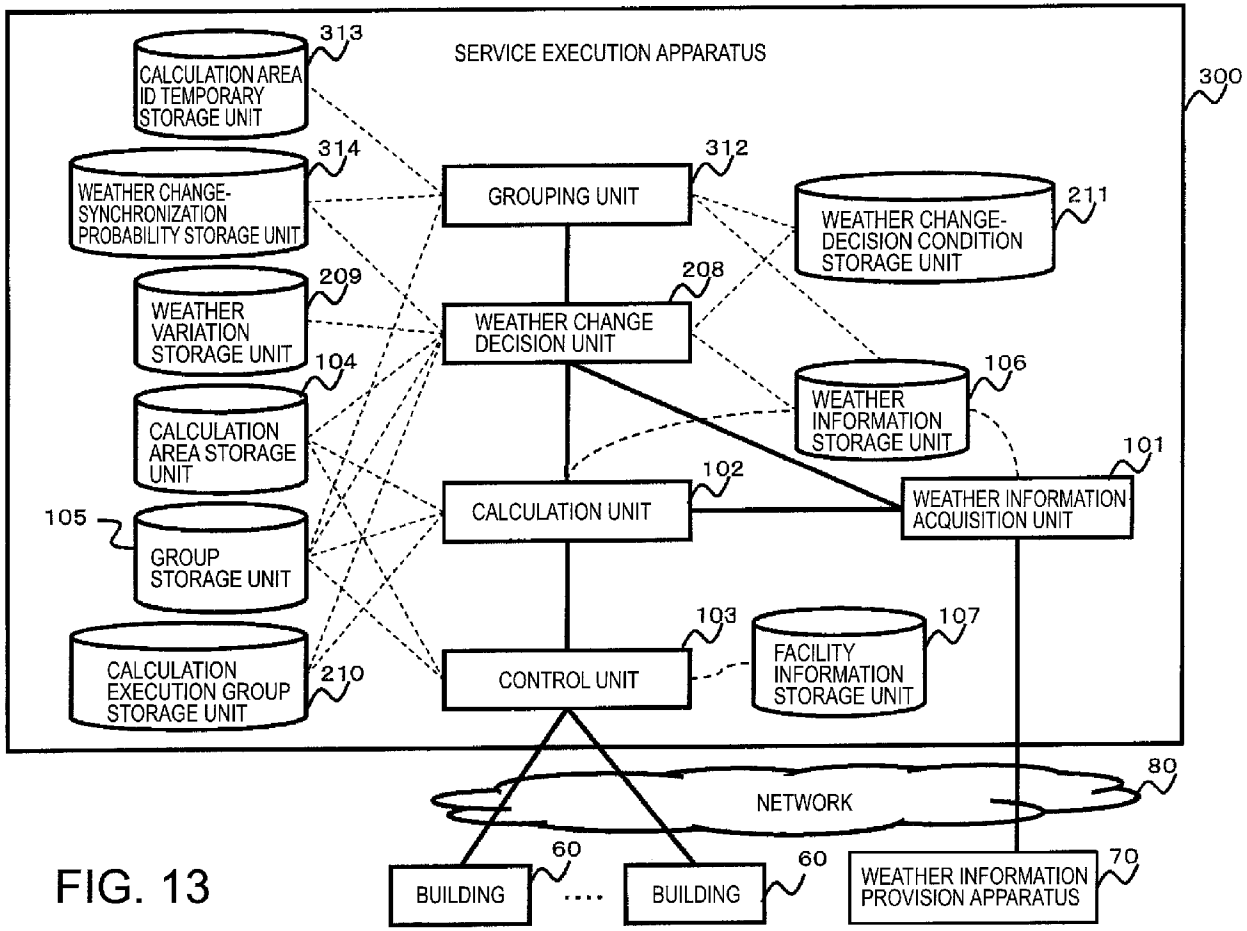
FIG. 13 is a block diagram of a system including a service execution apparatus 300 according to the third embodiment.

In the third embodiment, in order to solve this problem, a service execution apparatus 300 for grouping calculation areas of which timings of weather change coincide at a high probability is proposed. FIG. 13 is a block diagram of a system including the service execution apparatus 300 according to the third embodiment.

In addition to the service execution apparatus 200 of the second embodiment, the service execution apparatus 300 includes a grouping unit 312, a calculation area ID temporary storage unit 313, and a weather change-synchronization probability storage unit 314.

Based on information stored in the weather change-synchronization probability storage unit 314 (explained afterwards), the grouping unit 312 groups calculation areas of which timings of weather change coincide (synchronize) at a high probability.

The calculation area ID temporary storage unit 313 temporarily stores ID of a calculation area of which weather is decided to have changed as a decision result of weather change.

The weather change-synchronization probability storage unit 314 stores a synchronization probability of timing of weather change among calculation areas. Briefly, as to each calculation area, the calculation area ID, the number of synchronization of a timing of weather change, and a probability to synchronize with a timing of weather change, are stored. The number of synchronization of a timing of weather change is stored for each of other calculation areas. The probability to synchronize with a timing of weather change is also stored for each of other calculation areas.

FIG. 14 shows one example of information stored in the weather change-synchronization probability storage unit 314. In FIG. 14, the number of synchronization of a timing of weather change between the calculation areas 1 and 2 is ten, the number of synchronization of a timing of weather change between the calculation areas 1 and 3 is twenty, and the number of synchronization of a timing of weather change between the calculation areas 2 and 3 is thirty. Furthermore, the number of times to decide whether weather has changed in the past is forty. Accordingly, the probability to synchronize a timing of weather change between the calculation areas 1 and 2 is 10/40=25%, the probability to synchronize a timing of weather change between the calculation areas 1 and 3 is 20/40=50%, and the probability to synchronize a timing of weather change between the calculation areas 2 and 3 is 30/40=75%.

Figure 15:
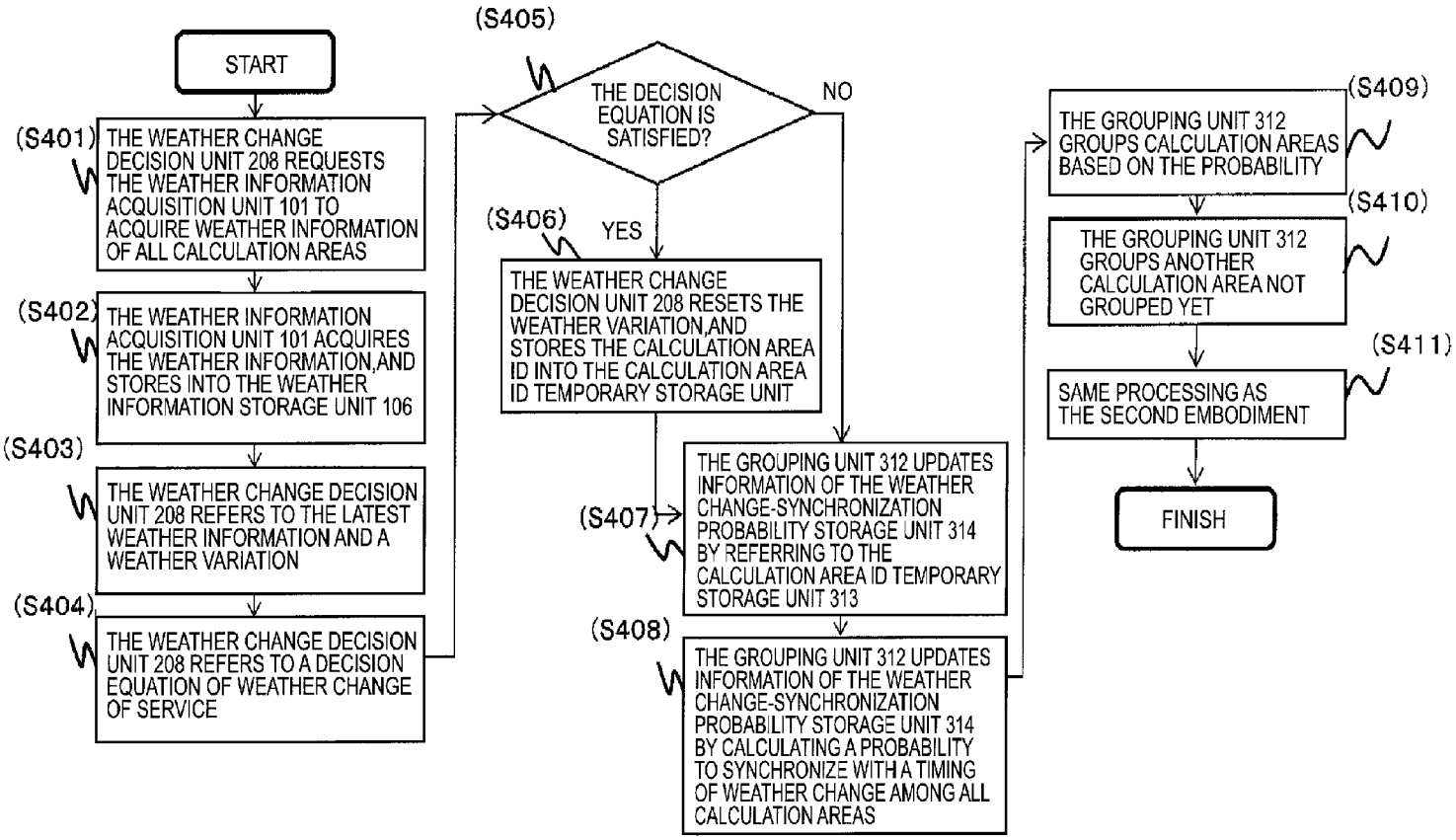
FIG. 15 is a flow chart of processing of the service execution apparatus 300 of FIG. 13.

Next, operation of the service execution apparatus 300 of the third embodiment is explained. FIG. 15 is a flow chart of processing of the service execution apparatus 300 of the third embodiment.

First, by referring to information of all calculation areas stored in the calculation area storage unit 104, the weather change decision unit 208 requests the weather information acquisition unit 101 to acquire weather information related to all calculation areas at a predetermined interval (S401) (Refer to FIG. 3). Furthermore, the number of times to decide whether weather has changed is incremented by "1".

Next, based on the weather information ID provided, the weather information acquisition unit 101 acquires weather information, and stores it into the weather information storage unit 106 (S402) (Refer to FIG. 5). Furthermore, the weather information acquisition unit 101 notifies the weather change decision unit 208 of completion of acquisition.

Next, the weather change decision unit 208 executes decision processing of weather change for each calculation area. First, by using the latest weather information (stored in the weather information storage unit 106) and the past weather variation (stored in the weather variation storage unit 209), the weather change decision unit 208 calculates the present weather variation (S403) (Refer to FIG. 5).

Next, by referring to the weather change-decision condition storage unit 211, the weather change decision unit 208 grasps a decision equation of weather change (S404) (Refer to FIG. 10).

Next, based on the present weather variation, the weather change decision unit 208 decides whether the decision equation is satisfied (S405) (Refer to FIGS. 5 and 10).

When the decision equation is satisfied (Yes at S405), it is decided that weather has changed. In this case, the weather change decision unit 208 stores the calculation area ID into the calculation area ID temporary storage unit 313 (S406). On the other hand, when the decision equation is not satisfied, processing is forwarded to S407.

Next, when decision processing of weather change of each calculation area is completed, by referring to the calculation area ID temporary storage unit 313, the grouping unit 312 grasps IDs of calculation areas of which weather has changed. Then, as to each of the calculation areas, the grouping unit 312 increments the number of synchronization stored in the weather change-synchronization probability storage unit 314 by "1" (S407) (Refer to FIG. 14). For example, if the calculation areas 1 and 2 are stored in the calculation area ID temporary storage unit 313, the number of synchronization between the calculation areas 1 and 2 is incremented by "1".

Next, the grouping unit 312 calculates a probability to synchronize with a timing of weather change (stored in the weather change-synchronization probability storage unit 314) among the calculation areas (S408) (Refer to FIG. 14). The probability is calculated by (the number of synchronization)/(the number of times to decide whether weather has changed).

Next, the grouping unit 312 groups calculation areas of which the probability is above a threshold (S409). Then, the grouping unit 312 assigns an ID to this group, and selects a head calculation area from the calculation areas of the group. For example, the head calculation area may be selected at random.

Furthermore, the grouping unit 312 groups another calculation area (not grouped yet) of which the probability is below the threshold (S410). For example, by calculating an average value (a center of gravity) of coordinates of calculation areas in each group, the another calculation area may belong to a group having the center of gravity from which a distance thereof is the shortest.

After grouping of all calculation areas is completed, in the same way as the second embodiment, the weather change decision unit 208, the calculation unit 102 and the control unit 103, respectively operate. Briefly, they execute processing of flow charts shown in FIGS. 11 and 12. Moreover, whenever grouping of S409 and S410 is executed, processing of S411 (FIGS. 11 and 12) may not be executed. Briefly, grouping processing of S401~S410 and processing of S411 may be independently executed at different timing.

Moreover, in the third embodiment, as a reference of grouping, the grouping unit 312 groups calculation areas of which timings of weather change coincide at a high probability. However, the reference of grouping is not limited to this processing. For example, calculation areas of which the number of synchronization of a timing of weather change is above a specific value may be grouped. In this case, by storing the number of synchronization among all calculation areas in a predetermined period into the weather change-synchronization probability storage unit 314, calculation areas of which the number of synchronization is above the specific value may be grouped.

Thus far, operation of the service execution apparatus 300 of the third embodiment is already explained. According to the third embodiment, calculation areas of which timings of weather change coincide at a high probability are grouped. Accordingly, in spite of weather change around calculation areas, when calculation and control are not executed for the calculation areas, the number of such calculation areas can be reduced. As a result, in comparison with the second embodiment, comfortability and efficiency of energy saving of each calculation area can rise.

(The Fourth Embodiment)

As the reference of grouping, the physical coordinate is explained in the first embodiment, and the synchronization probability of timing of weather change is explained in the third embodiment. However, by grouping based on this reference, a group of which the number of calculation areas is extremely large is often created. In this case, whether to omit calculation for the group of which the number of calculation areas is large greatly affects on processing load of the service execution apparatus. Briefly, the case of large processing load and the case of small processing load occur every calculation cycle. In this case, the processing load is not smoothed along a time axis. As a result, effective usage of server resources is difficult.

Figure 16:
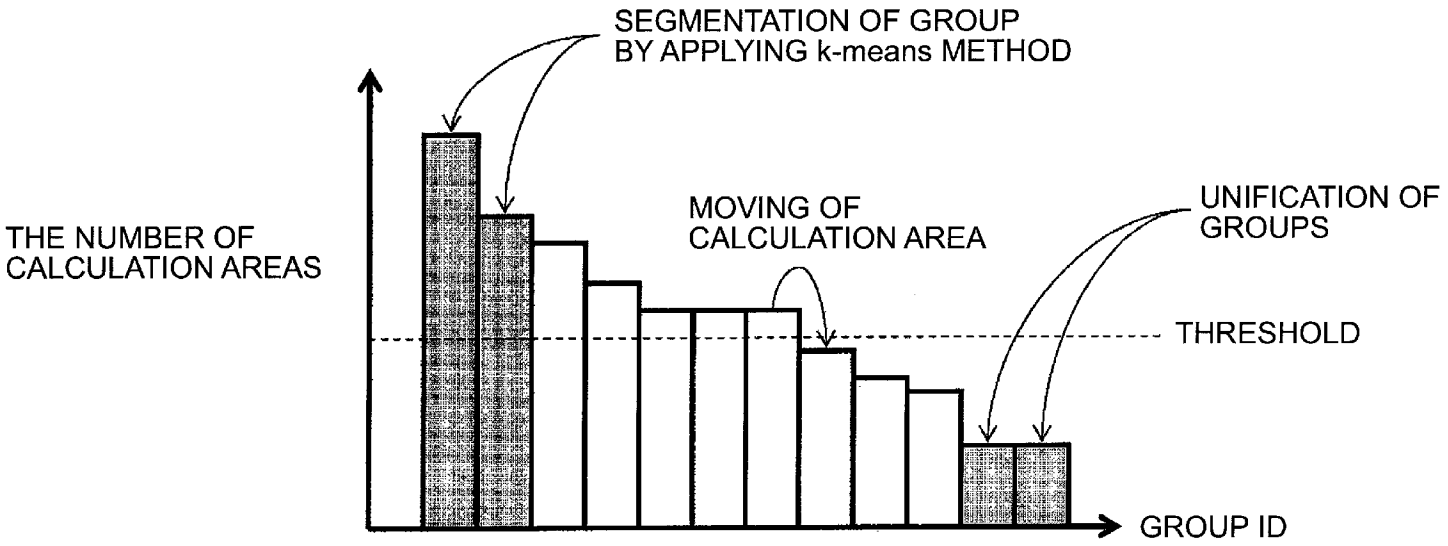
FIG. 16 is a schematic diagram showing a grouping method according to the fourth embodiment.
Figure 17:
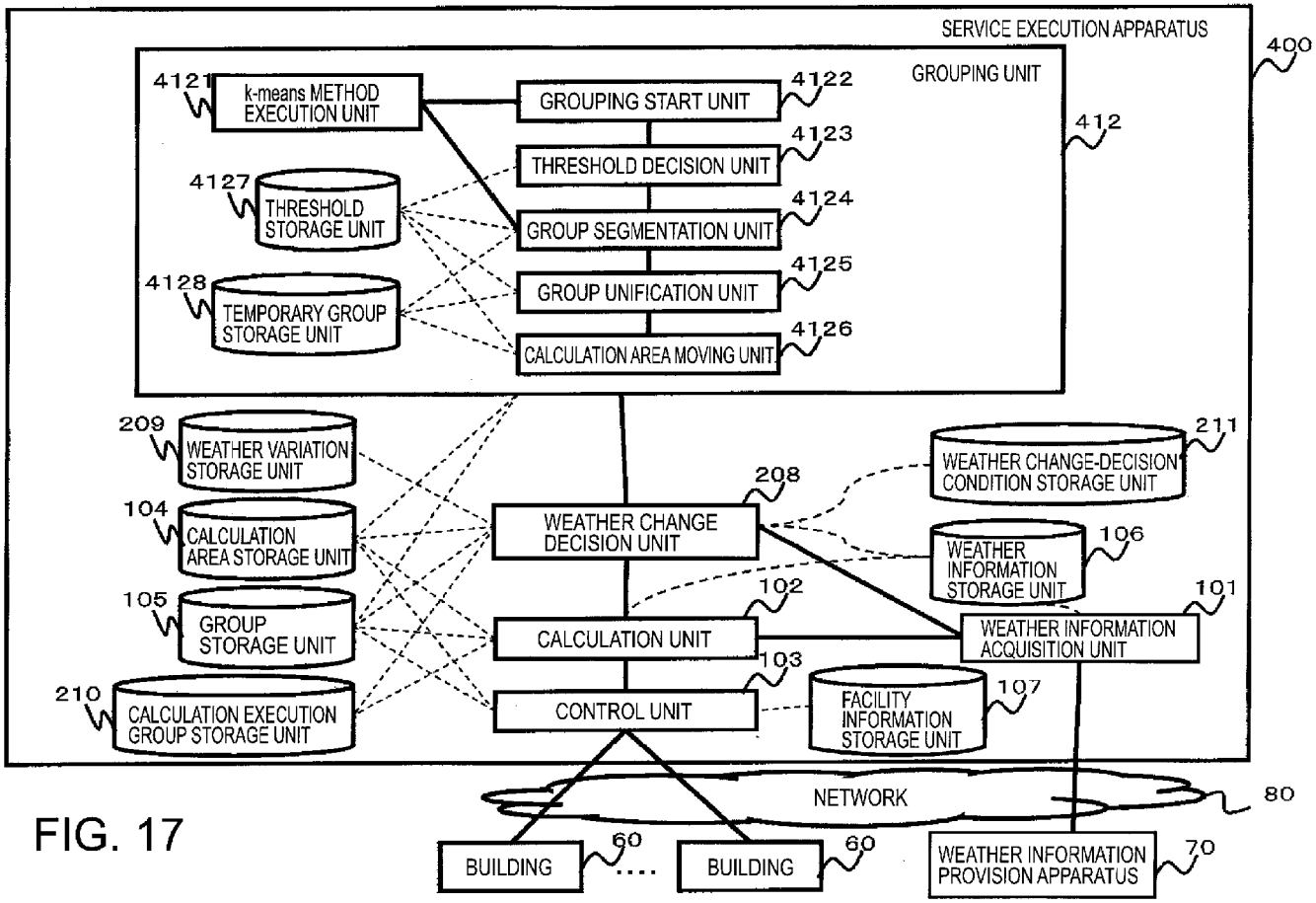
FIG. 17 is a block diagram of a system including a service execution apparatus 400 according to the fourth embodiment.

In the fourth embodiment, in order to solve above-mentioned problem, a service execution apparatus 400 for equalizing the number of calculation areas as much as possible is explained. Especially, after grouping calculation areas by using k-means method for grouping data (equivalent to the calculation area), a group of which the number of data is large is segmented, and groups of which the number of data is respectively few are unified (k-means method is well-known grouping method). By equalizing the number of calculation areas in each group, the processing load is smoothed, and the server resources can be effectively utilized. FIG. 16 is a schematic diagram showing operation of grouping of the fourth embodiment. FIG. 17 is a block diagram of a system including the service execution apparatus 400 of the fourth embodiment.

In addition to the service execution apparatus 200 of the second embodiment, the service execution apparatus 400 of the fourth embodiment includes a k-means method execution unit 4121, a grouping start unit 4122, a threshold decision unit 4123, a group segmentation unit 4124, a group unification unit 4125, a calculation area moving unit 5126, a threshold storage unit 4127, and a temporary group storage unit 4128. Hereinafter, each unit is explained.

The k-means method execution unit 4121 groups calculation areas by k-means method. In k-means method, data are segmented into groups (of k-units) based on coordinates of the data. Here, "k" is a parameter (previously set) of k-means method. In k-means method, coordinates of the data are used. Accordingly, calculation areas adjacently existing are clustered into the same group. However, in k-means method, the number of data included in each group is not referred. Accordingly, the number of calculation areas in each group cannot be equalized.

The grouping start unit 4122 starts grouping of calculation areas. Here, the grouping start unit 4122 preserves an initial value K to use k-means method.

The threshold decision unit 4123 determines a threshold used for segmentation and unification of group.

The group segmentation unit 4124 segments a group of which the number of calculation areas is large. The group unification unit 4125 unifies groups of which the number of calculation areas is respectively few. The calculation area moving unit 4126 moves a calculation area from a group of which the number of calculation areas is large to another group of which the number of calculation areas is few. Here, moving of a calculation area means change of a group including the calculation area, and does not mean physical movement of the calculation area.

The threshold storage unit 4127 stores the threshold determined by the threshold decision unit 4123.

The temporary group storage unit 4128 temporarily stores a status of groups after segmentation and unification thereof. Accordingly, a format of information therein is same as the format of FIG. 4.

Figure 18:
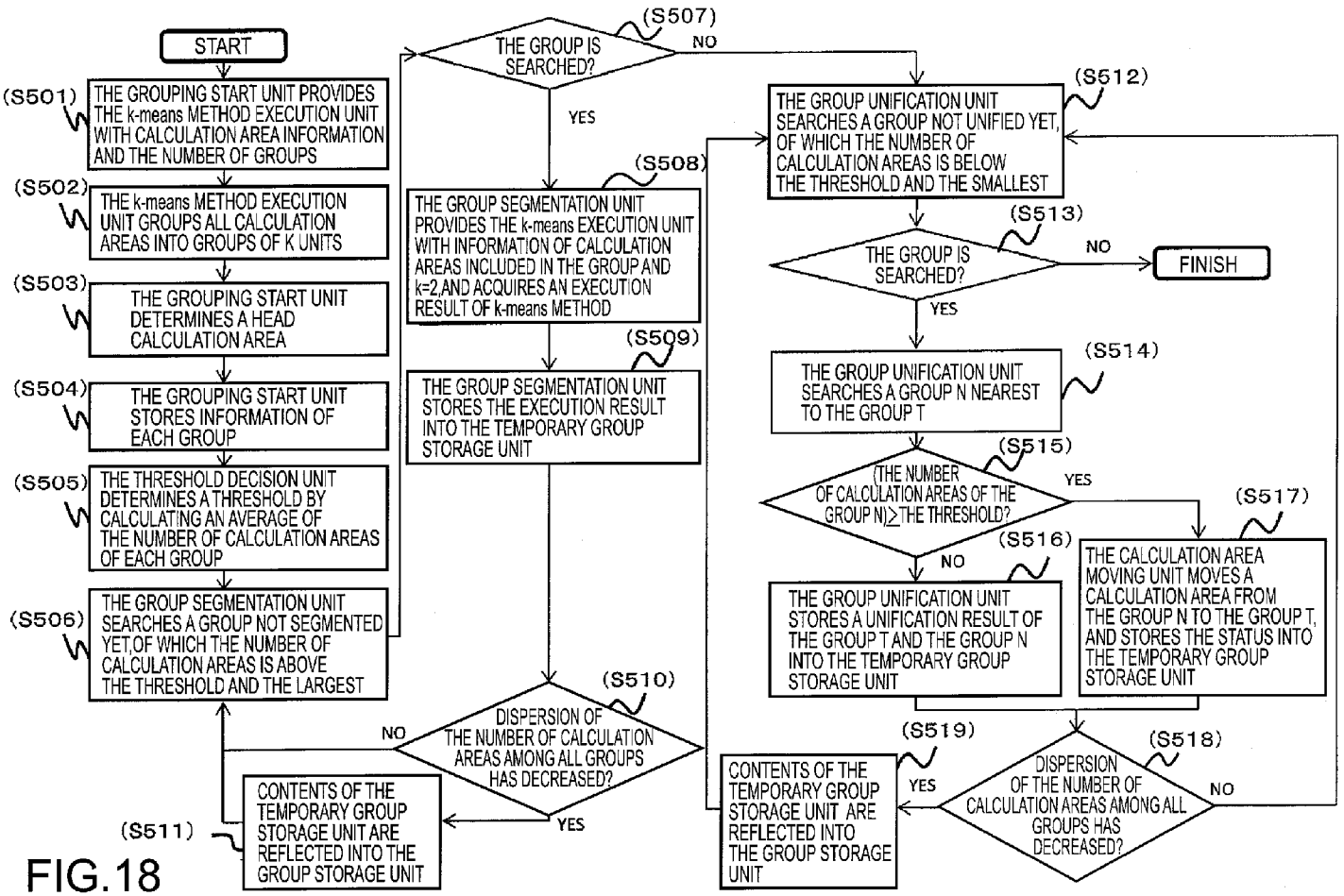
FIG. 18 is a flow chart of processing of a grouping unit 412 in the service execution apparatus 400 of FIG. 17.

FIG. 18 is a flow chart of processing of the grouping unit 412. By referring to FIG. 18, operation of the grouping unit 412 is explained.

The grouping start unit 4122 requests the k-means method execution unit 4121 to execute grouping of all calculation areas (S501). The parameter of k-means method is K (previously set).

Next, by using k-means method, the k-means method execution unit 4121 clusters calculation areas into groups (of K units) based on a coordinate of each calculation area (S502). Then, the k-means method execution unit 4121 provides the grouping start unit 4122 with a grouping result (information of each group).

Next, the grouping start unit 4122 determines a head calculation area of each group (S503).

Next, the grouping start unit 4122 stores the information of each group into the group storage unit 105 (S504).

Next, by referring to the information of each group, the threshold decision unit 4123 calculates an average value of the number of calculation areas included in each group. By setting the average value to a threshold T, the threshold decision unit 4123 stores the threshold T into the threshold storage unit 4127 (S505).

Next, by referring to the number of calculation areas of each group, the group segmentation unit 4124 searches a group of which the number of calculation areas is above the threshold T and to which group-segmentation processing (S508~S511) is not subjected (S506, S507).

When the group is not searched (No at S507), the group segmentation unit 4124 provides the group unification unit 4125 with processing (S512). When at least one group is searched (Yes at S507), the group segmentation unit 4124 selects one group of which the number of calculation areas is the largest among the groups searched as "segmentation target group A", and starts group-segmentation processing (forwarded to S508).

Next, the group segmentation unit 4124 provides the k-means method execution unit 4124 with information of calculation areas included in the group A, and requests to segment the calculation areas into two groups. Briefly, parameter of k-means method is 2. The k-means method execution unit 4121 clusters the group A into two groups. As a result, the k-means method execution unit 4121 generates two group A-1 and A-2, and provides the group segmentation unit 4124 with information of the two groups (S508).

Next, the group segmentation unit 4124 stores information of the two groups A-1 and A-2, and other groups (except for the group A) into the temporary group storage unit 4128 (S509).

As a result of group-segmentation, it is decides whether a dispersion of the number of calculation areas among all groups has decreased (S510). Here, information of all groups before segmentation is stored in the group storage unit 105, and information of all groups after segmentation is stored in the temporary group storage unit 4128. When the dispersion is decided to have increased (No at S510), processing is returned to S506. When the dispersion is decided to have decreased (Yes at S510), contents of the group storage unit 105 is overwritten by contents of the temporary group storage unit 4128 (S511), and processing is returned to S506.

After that, processing of S506~S511 is repeatedly executed. Hereinafter, processing in case of No at S507 is explained.

By referring to the number of calculation areas in each group, the group unification unit 4125 searches a plurality of groups of which the number of calculation areas is below the threshold T and to which group-unification processing (S514~S519) is not subjected (S512, S513). When the plurality of groups is searched (Yes at S513), the group unification unit 4125 selects one group of which the number of calculation areas is the smallest from the plurality of groups, and sets the one group as "unification target group B". When the plurality of groups is not searched (No at S513), processing of the grouping unit 412 is completed.

The group unification unit 4125 searches a group C nearest to the group B (S514). Here, a distance between two groups is defined as a distance between two centers of gravity thereof. A center of gravity of a group is defined as an average value of coordinates of all calculation areas included in the group.

Next, the group unification unit 4125 decides whether the number of calculation areas in the group C is above a threshold (S515).

When the number of calculation areas in the group C is below the threshold (No at S515), the group unification unit 4125 unifies the group B and the group C. Then, the group unification unit 4125 stores information of all groups (the groups B and C are already unified) into the temporary group storage unit 4128 (S516).

When the number of calculation areas in the group C is above the threshold (Yes at S515), the calculation area moving unit 4126 moves a calculation area from the group C to the group B (S517). The calculation area to be moved is a calculation area nearest to a center of gravity of the group B.

As a result of group-unification or moving of calculation area, it is decides whether a dispersion of the number of calculation areas among all groups has decreased (S518). Here, information of all groups before unification and moving is stored in the group storage unit 105, and information of all groups after unification and moving is stored in the temporary group storage unit 4128. When the dispersion is decided to have increased (No at S518), processing is returned to S512. When the dispersion is decided to have decreased (Yes at S518), contents of the group storage unit 105 is overwritten by contents of the temporary group storage unit 4128 (S519), and processing is returned to S512.

After that, processing of S512~S519 is repeatedly executed until No at S513. In case of No at S513, processing is completed. As a result of above-mentioned processing, grouping of all calculation areas is completed.

In the fourth embodiment, grouping processing of calculation areas is explained. After completing the grouping, processing of the service execution apparatus 400, i.e., processing of the weather change decision unit 208, the calculation unit 102 and the control unit 103, is same as processing of the first embodiment or the second embodiment. Concretely, for example, by processing of flowcharts in FIGS. 11 and 12 of the second embodiment, operation of energy saving service for each calculation area is executed.

In this way, in the service execution apparatus 400 of the fourth embodiment, in order to equalize the number of calculation areas of each group as much as possible, segmentation and unification of groups are executed. Accordingly, the processing load can be smoothed, and server resources can be effectively utilized. As a result, comfortability and efficiency of energy saving in calculation area can be maintained.

Moreover, in the fourth embodiment, after the k-means method execution unit 4121 executes grouping of calculation areas by k-means method, as to calculation areas of each group, the group segmentation unit 4124 and the group unification unit 4125 executes group-segmentation and group-unification. However, as a first grouping, k-means method is not always utilized. For example, as explained in the first embodiment, by setting a threshold L of a physical distance, after calculation areas of which the physical distance is within the threshold L are grouped as the same group, group-segmentation and group-unification may be executed. Furthermore, as explained in the second embodiment, after calculation areas of which the synchronization probability is high are grouped as the same group, group-segmentation and group-unification may be executed.

As mentioned-above, according to the first, second, third and fourth embodiments, calculation areas are grouped by referring to physical coordinates or weather information thereof, and calculation processing of the control value is executed for only the head calculation area of the group. As a result, in comparison with the case of executing calculation for each calculation area, a load of the calculation processing can be reduced.

In the disclosed embodiments, the processing can be performed by a computer program stored in a computer-readable medium.

In the embodiments, the computer readable medium may be, for example, a magnetic disk, a flexible disk, a hard disk, an optical disk (e.g., CD-ROM, CD-R, DVD), an optical magnetic disk (e.g., MD). However, any computer readable medium, which is configured to store a computer program for causing a computer to perform the processing described above, may be used.

Furthermore, based on an indication of the program installed from the memory device to the computer, OS (operation system) operating on the computer, or MW (middle ware software), such as database management software or network, may execute one part of each processing to realize the embodiments.

Furthermore, the memory device is not limited to a device independent from the computer. By downloading a program transmitted through a LAN or the Internet, a memory device in which the program is stored is included. Furthermore, the memory device is not limited to one. In the case that the processing of the embodiments is executed by a plurality of memory devices, a plurality of memory devices may be included in the memory device.

A computer may execute each processing stage of the embodiments according to the program stored in the memory device. The computer may be one apparatus such as a personal computer or a system in which a plurality of processing apparatuses are connected through a network. Furthermore, the computer is not limited to a personal computer. Those skilled in the art will appreciate that a computer includes a processing unit in an information processor, a microcomputer, and so on. In short, the equipment and the apparatus that can execute the functions in embodiments using the program are generally called the computer.

While certain embodiments have been described, these embodiments have been presented by way of examples only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An apparatus for controlling facility devices in a group, the group including a plurality of calculation areas for which timings of weather change coincide with a likelihood exceeding a threshold likelihood, at least one facility device being installed in each calculation area, the apparatus comprising:

a calculation unit configured to calculate a control value to control a selected facility device installed in one of the calculation areas in the group, using weather information relating to the one of the calculation areas; and a control unit configured to control other facility devices installed in the calculation areas of the group, based on the control value for the selected facility device.

2. The apparatus according to claim 1, wherein the calculation areas of the group are adjacent each other.

3. The apparatus according to claim 1, further comprising:

a decision unit configured to decide whether weather has changed for the group, based on a variation of the weather information of the one of the calculation areas included in the group;

wherein, when the decision unit decides that the weather has changed for the group, the calculation unit calculates the control value to control the selected facility device installed in the one of the calculation areas in the group.

4. The apparatus according to claim 1, further comprising:

a group segmentation unit configured to segment the group when the number of calculation areas included in the group is above a threshold.

5. The apparatus according to claim 1, wherein the apparatus further controls facility devices in another group, the other group including a plurality of calculation areas, at least one facility device being installed in each calculation area, further comprising:

a group unification unit configured to unify the group and the other group when the number of calculation areas included in each of the group and the other group is below the threshold.

6. An apparatus for controlling facility devices in calculation areas, comprising:

a decision unit configured to decide whether weather has changed for each calculation area, based on a variation of weather information relating to each calculation area;

a first storage to store a probability to synchronize a timing of respective weather changes among calculation areas, based on a decision result by the decision unit;

a grouping unit configured to form a group including at least two of the calculation areas, the probability associated with the at least two calculation areas being above a threshold;

a calculation unit configured to calculate a control value to control a selected facility device installed in one of the calculation areas in the group, using the weather information relating to the one of the calculation areas; and a control unit configured to control other facility devices installed in the calculation areas of the group, based on the control value for the selected facility device.

7. An apparatus for controlling facility devices in calculation areas, comprising:

a decision unit configured to decide whether weather has changed for each calculation area, based on a variation of weather information relating to each calculation area;

a first storage to store the number of synchronizations of a timing of respective weather changes among calculation areas, based on a decision result by the decision unit;

a grouping unit configured to form a group including at least two of the calculation areas, the number of synchronizations associated with the at least two calculation areas being above a specific value;

a calculation unit configured to calculate a control value to control a selected facility device installed in one of the calculation areas in the group, using the weather information relating to the one of the calculation areas; and a control unit configured to control other facility devices installed in the calculation areas of the group, based on the control value for the selected facility device.

8. An apparatus for controlling facility devices in calculation areas, comprising:

a grouping unit configured to form a group including at least two of the calculation areas for which timings of weather change coincide with a likelihood exceeding a threshold likelihood, by using k-means method;

a calculation unit configured to calculate a control value to control a selected facility device installed in one of the calculation areas in the group, using weather information relating to the one of the calculation areas; and a control unit configured to control other facility devices installed in the calculation areas of the group, based on the control value for the selected facility device.

9. A method for controlling facility devices in a group, the group including a plurality of calculation areas for which timings of weather change coincide with a likelihood exceeding a threshold likelihood, at least one facility device being installed in each calculation area, comprising:

calculating a control value to control a selected facility device installed in one of the calculation areas in the group, using weather information relating to the one of the calculation areas; and controlling other facility devices installed in the calculation areas of the group, based on the control value for the selected facility device.

10. A non-transitory computer readable medium storing a program which, when executed by a computer, causes the computer to perform operations for controlling facility devices in a group, the group including a plurality of calculation areas for which timings of weather change coincide with a likelihood exceeding a threshold likelihood, at least one facility device being installed in each calculation area, the operations comprising:

calculating a control value to control a selected facility device installed in one of the calculation areas in the group, using weather information relating to the one of the calculation areas; and controlling other facility devices installed in the calculation areas of the group, based on the control value for the selected facility device.

11. A method for controlling facility devices in calculation areas, comprising:

deciding whether weather has changed for each calculation area, based on a variation of weather information relating to each calculation area;

storing a probability to synchronize a timing of respective weather changes among calculation areas, based on a decision result by the deciding;

forming a group including at least two of the calculation areas, the probability associated with the at least two calculation areas being above a threshold;

calculating a control value to control a selected facility device installed in one of the calculation areas in the group, using the weather information relating to the one of the calculation areas; and controlling other facility devices installed in the calculation areas of the group, based on the control value for the selected facility device.

12. A non-transitory computer readable medium storing a program which, when executed by a computer, causes the computer to perform operations for controlling facility devices in calculation areas, the operations comprising:

deciding whether weather has changed for each calculation area, based on a variation of weather information relating to each calculation area;

storing a probability to synchronize a timing of respective weather changes among calculation areas, based on a decision result by the deciding;

forming a group including at least two of the calculation areas, the probability associated with the at least two calculation areas being above a threshold;

calculating a control value to control a selected facility device installed in one of the calculation areas in the group, using the weather information relating to the one of the calculation areas; and controlling other facility devices installed in the calculation areas of the group, based on the control value for the selected facility device.

* * * * *